US005975386A

United States Patent [19]

Fernicola

[11] Patent Number: 5,975,386

[45] Date of Patent: Nov. 2, 1999

[54] TOOL FOR PULLING ZIPPERS LOCATED ON THE BACK OF GARMENTS

[76] Inventor: Linda Carol Fernicola, 2810 Potomac Dr., Garland, Tex. 75042

[21] Appl. No.: 09/137,215

[22] Filed: Aug. 20, 1998

[51] Int. Cl.[6] ..... A47G 25/90

[52] U.S. Cl. ..... 223/111; 294/3.6

[58] Field of Search ..... 223/111; 401/243; 294/3.6, 170

[56] References Cited

U.S. PATENT DOCUMENTS

| | | | |
|---|---|---|---|
| D. 238,630 | 2/1976 | Anamoms | D2/7 |
| D. 286,461 | 11/1986 | Higgins | D11/221 |
| D. 296,882 | 7/1988 | Lopez | D11/221 |
| D. 303,511 | 9/1989 | Minami | D11/221 |
| D. 311,158 | 10/1990 | Soule | D11/221 |
| D. 320,367 | 10/1991 | Kalbach | D11/221 |
| D. 355,147 | 2/1995 | Frano | D11/221 |
| 2,888,728 | 6/1959 | Lebermann | 24/205.15 |
| 5,336,011 | 8/1994 | Ferguson et al. | 401/247 |
| 5,500,966 | 3/1996 | Wheat | 7/169 |
| 5,590,971 | 1/1997 | Melnick | 401/202 |
| 5,603,542 | 2/1997 | Walker | 294/3.6 |
| 5,855,401 | 1/1999 | Papernik | 294/2 |

*Primary Examiner*—Bibhu Mohanty
*Attorney, Agent, or Firm*—Goldstein & Canino

[57] ABSTRACT

A zipper manipulating tool for opening and closing zippers located on the back of garments comprising an elongated body having a head portion for slidably receiving a cap. The end of the head portion is provided with a hook member adapted to be inserted into an eye formed within a zipper pull-tab and a spring-biased latch pin coupled to a toggle button to open and close the latch. A flexible cord is connected between the tool body at the end opposite to the hook member and the cap. In use, the zipper manipulating tool is attached to a garment zipper before it is worn by inserting the hook member into the eye formed within the zipper pull-tab. The cap attached to the tool body via the flexible cord serves as a handle to pull the zipper open or close.

7 Claims, 3 Drawing Sheets

TOOL FOR PULLING ZIPPERS LOCATED ON THE BACK OF GARMENTS

BACKGROUND OF THE INVENTION

This invention relates to a zipper manipulating tool. More particularly, the invention relates to a tool which can be releasably attached to a zipper located on the back of a garment to help a user open and close the zipper.

Many people have trouble reaching and manipulating zippers located on the back of garments. When alone, it may not be possible for an individual to dress into or out of a garment that has a zipper on the back. Even if it is possible to reach the zipper, a dangerous amount of physical strain can be placed on the body caused by all the twisting and turning in the process of struggling to open or close the zipper. This struggle cannot only result in bodily injury, but also can damage the garment as a result of forcibly pulling the zipper. Thus, it is desirable to have a tool that can assist a user in the opening and closing of a zipper in a hard-to-reach location without requiring the twisting and turning of the user's body as would be necessary if the tool was not available.

In an attempt to solve the problems associated with the opening and closing of zippers, several references uncovered in the prior art have been proposed for assisting individuals who have a difficulty in manipulating a zipper. For example, U.S. Pat. No. 5,500,966 to Wheat discloses a tool to be used by an individual having extremely long fingernails for facilitating the manipulation of zippers as well as for facilitating the opening of beverage cans. While these units mentioned above may be suitable for the particular purpose employed, or for general use, they would not be as suitable for the purposes of the present invention as disclosed hereafter.

SUMMARY OF THE INVENTION

It is an object of the invention to provide a zipper manipulating tool which is simple in construction so as to minimize manufacturing cost, and yet enables individuals to open and close zippers located on the back of garments.

It is another object of the invention to provide a zipper manipulating tool which is capable of eliminating physical strains and injury, as well as damage to a garment that can be caused while dressing into or out of a garment that has zipper on the back.

It is yet another object of the invention to provide a zipper manipulating tool having a small pen-like configuration for convenient carrying and storage purposes so that it is readily accessible when needed.

It is a further object of the invention to provide a zipper manipulating tool including a body, a cap, and an elastic cord connected therebetween, wherein the cap can be used as a handle when it is detached from the body to pull zipper open or close.

The invention is a zipper manipulating tool for opening and closing zippers located on the back of garments comprising an elongated body having a head portion for slidably receiving a cap. The end of the head portion is provided with a hook member adapted to be inserted into an eye formed within a zipper pull-tab and a spring-biased latch pin coupled to a toggle button to open and close the latch. A flexible cord is connected between the tool body at the end opposite to the hook member and the cap. In use, the zipper manipulating tool is attached to a garment zipper before it is worn by inserting the hook member into the eye formed within the zipper pull-tab. The cap attached to the tool body via the flexible cord serves as a handle to pull the zipper open or close.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
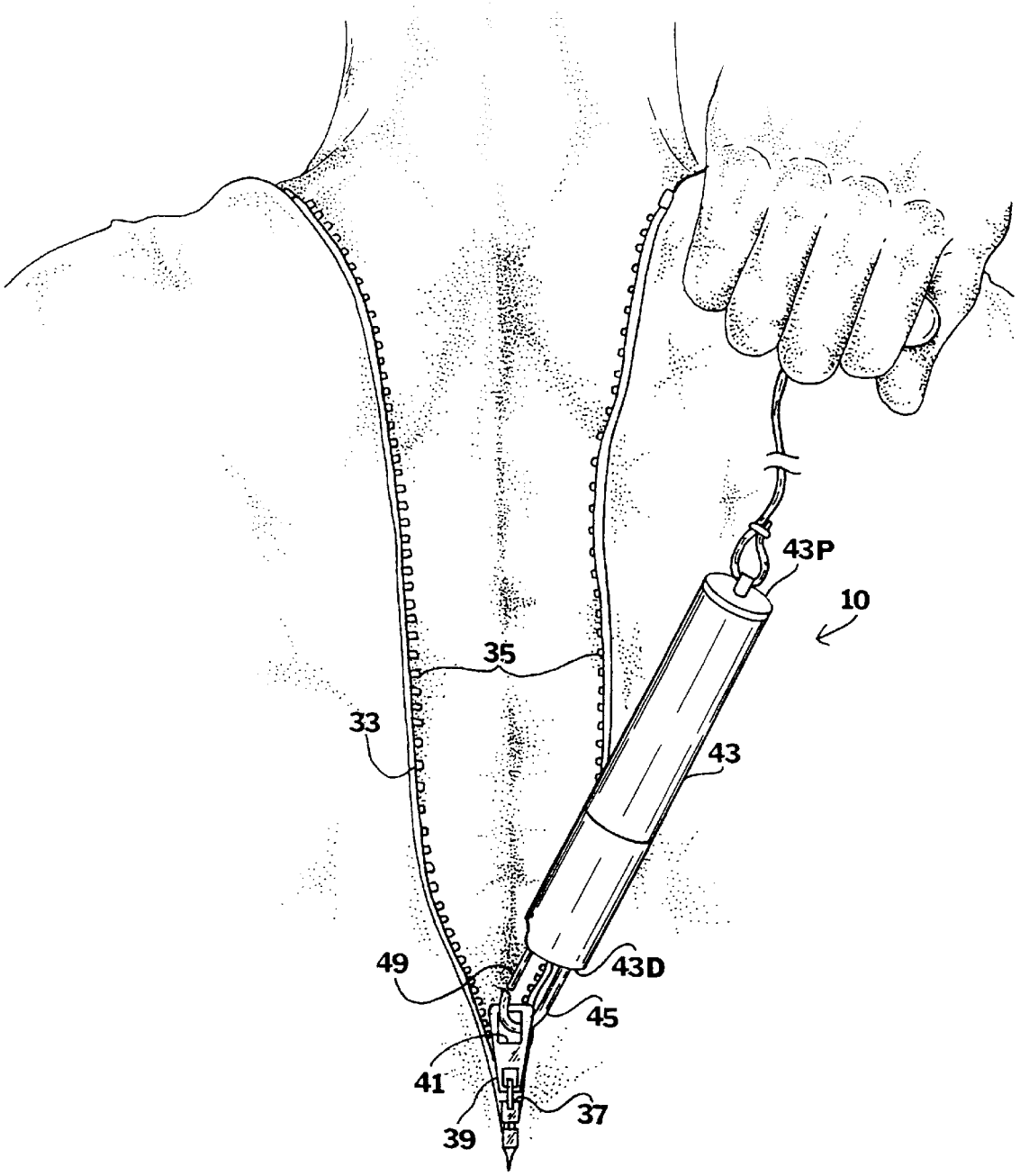
FIG. 1 is a diagrammatic perspective view of a zipper manipulating tool of the present invention being used by an individual.

FIG. 1 illustrates a preferred embodiment of a zipper manipulating tool 10 embodying the principles of the present invention. For better understanding of the present invention, a zipper 33 is illustrated consisting generally of two rows of metal or plastic teeth-like parts 35 which are brought together by pulling a small sliding piece 37 over them. Typically, a zipper pull-tab 39 is attached to the sliding piece 37 for moving the piece in a desired direction, and often has an eye 41 formed therein. As will be seen in the following paragraphs, the zipper manipulating tool 10 is designed to help individuals open and close zippers located on the back of garments.

The tool 10 of the present invention includes a body 43 having proximal 43P and distal 43D ends, which is preferably constructed of a plastic material or any other suitable light weight material. The body 43 has an overall pen-like shape for convenient carrying and storage purposes so that it is readily accessible when needed. Connecting means is provided at the distal end 43D of the body 43 for releasably attaching to the zipper pull-tab 39. As seen by referring to FIG. 2, the connecting means of the present invention includes a hook member 45 affixed to the body 43 at the distal end 43D such that an opening 47 is selectively formed between the hook member 45 and the body 43 for receiving the eye 41 of the zipper pull-tab 39. The diameter of the hook member 45 must be smaller than the diameter of the eye 41 in the zipper pull-tab 39 so that the hook member 45 can be inserted therein. The connecting means also includes a spring-biased latch pin 49 moveable to close or open the opening 47. A toggle button 51 is located at the side of the body 43 and is operatively coupled to the spring-biased latch pin 49 to permit selective movement thereof, wherein the spring-biased latch 49 may be pulled by operating the button 51 to open the opening 47, or released so that the latch pin 49 closes the opening 47.

Figure 2:
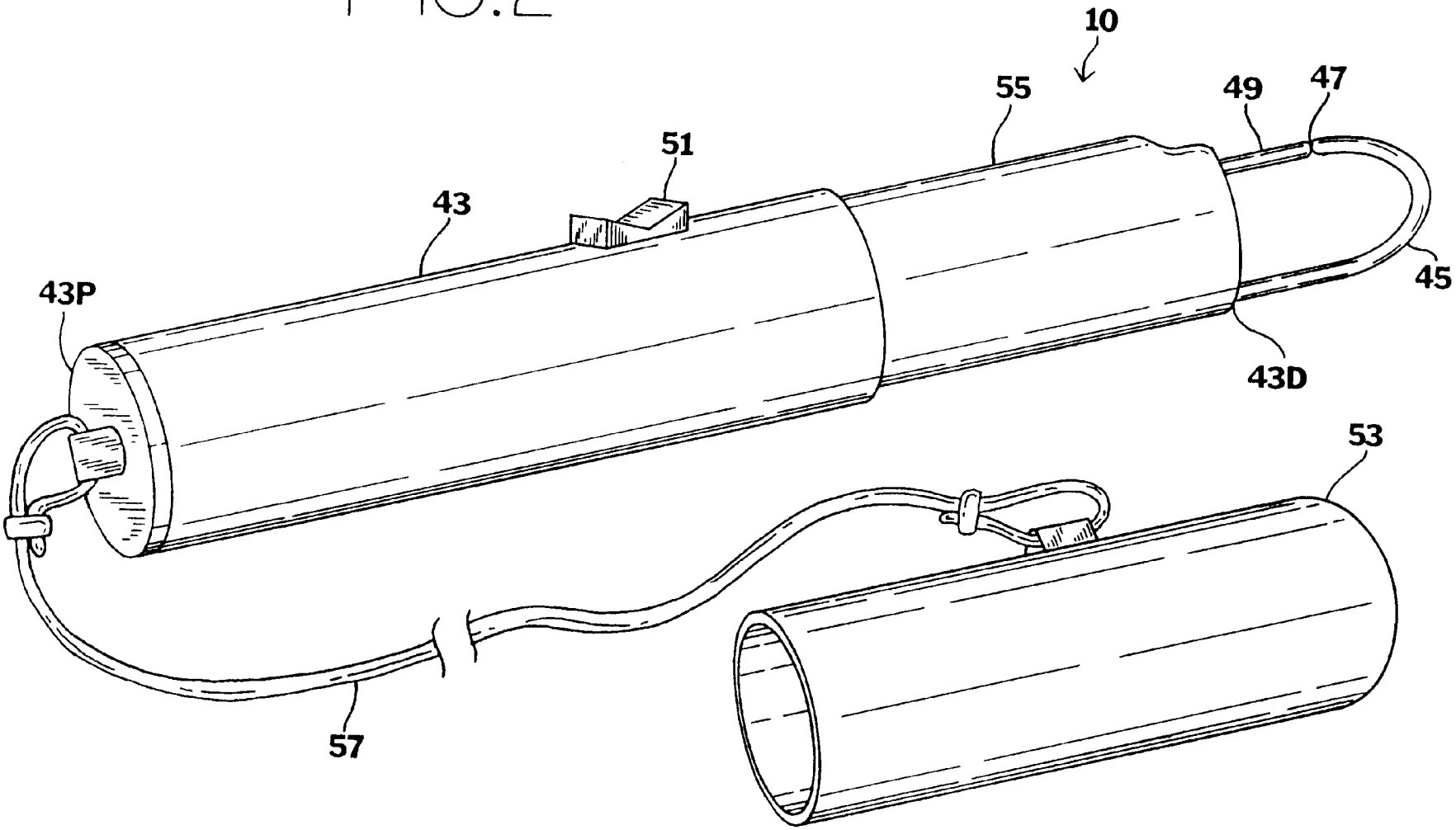
FIG. 2 is a diagrammatic perspective view of a preferred embodiment of the zipper manipulating tool embodying the principles of the present invention with the cap detached from the tool body.
Figure 3:
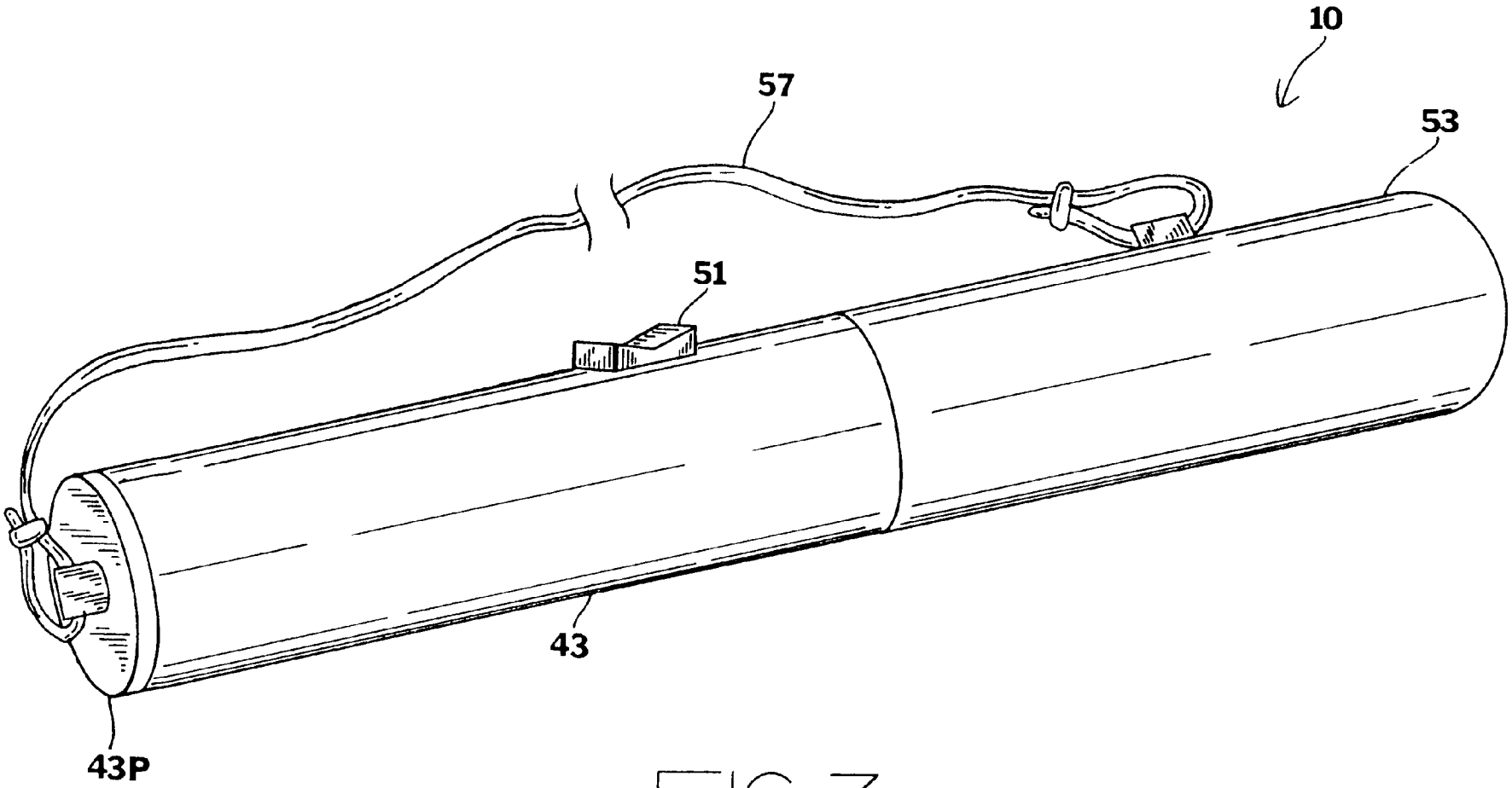
FIG. 3 is a diagrammatic perspective view of the zipper manipulating tool with the cap attached to the tool body for convenient carrying purposes.

In accordance with the present invention, a cap 53 is releasably attached to the tool body 43 at the distal end 43D. As shown in FIG. 2, the tool body 43 includes a head portion 55 having a slightly small diameter than the rest of the body, sized for snuggly receiving the cap 53. When the tool 10 is not in use, the cap 53 serves to cover the head portion 55 of the tool body 43 to protect the hook member 45 and the latch pin 49 from becoming damaged, as depicted in FIG. 3. The cap 53 may be coupled to the tool body 43 by means of threaded engagement, frictional fit, or by any other coupling means as would be appreciated by those skilled in the art.

In keeping with further aspects of the invention, a flexible cord 57 is connected between the tool body 43 at the proximal end 43P and the cap 53, the length of which is selected to provide sufficient extension from the tool body 43 when it is connected to a zipper pull-tab 39 near the lower back area of the user to the upper shoulder area so as to enable the user to grab the cap 53 over the shoulder, as depicted in FIG. 1. The flexible cord 57 can be constructed of inelastic or elastic material, and in the preferred embodiment the flexible cord possesses some elasticity to prevent the user from pulling the zipper pull-tab 39 with excessive force.

The operation of the zipper manipulating tool 10 will now be described. To reach a zipper on the back of a garment, the zipper manipulating tool is attached to the garment zipper while the garment is still on a hanger. The cap 53 is detached from the distal end 43D of the tool body 43. The button 51 located on the side of the tool can be toggled to retract the spring-biased latch pin 49 into the tool body 43 and thereby form the opening 47 between the hook member 45 and the distal end 43D of the body 43. The pull tab 39 is then inserted through the opening 47 thus formed until the hook member 45 extends through the eye 41 of said pull tab 39. The zipper pull-tab 39 is secured to the hook member of the tool body by releasing the button 51 so that the latch pin closes and eliminates the opening 47. Whereupon, the cap 53, which is now already detached from the tool body 43, is swung over the shoulder so that said cap 53 can be used as a handle to pull the zipper up. Alternatively, the cap 53 can extend downwardly from the tool body 43 to enable the user to pull the zipper down. In this manner, the tool 10 enables users to reach and manipulate zippers located on the back of garments without being subjected to the risk of injury to the body as a result of excessive twisting and turning movement.

Many specific details contained in the above description merely illustrate some preferred embodiments and should not be construed as a limitation on the scope of the invention. Many other variations are possible.

What is claimed is:

1. A zipper manipulating tool for opening and closing a zipper located in hard-to-reach areas, said zipper including a pull-tab having an eye formed therein, comprising:

a) a body having proximal and distal ends;

b) a cap for covering said distal end of the body;

c) a flexible cord attached between said cap and said body; and d) connector means provided at distal end of said body for releasably connecting to said eye in the zipper pull-tab.

2. The zipper manipulating tool as recited in claim 1, wherein the length of the flexible cord is selected to provide extension from the user's lower back area to the upper shoulder area so as to enable the user to grab the cap over the shoulder when the tool body is attached to a zipper on the back of a garment.

3. The zipper manipulating tool as recited in claim 2, wherein the connector means comprises a hook member and a spring-biased latch pin moveable to selective form and eliminate an opening between the latch pin and hook member, said hook member having a generally uniform cross section along its length and a diameter of which is smaller than the diameter of the eye in the zipper pull-tab so that the hook member can be inserted therein.

4. The zipper manipulating tool as recited in claim 3, further comprising a toggle button located on the body and operatively coupled to the spring-biased latch pin to permit selective movement between closed and open positions.

5. The zipper manipulating tool as recited in claim 2, wherein the body has a pen-like shape for convenient carrying and storage purposes and includes a head portion for snuggly receiving the cap, wherein the cap serves to cover said head portion of the body to protect the hook member and the latch pin from becoming damaged.

6. The zipper manipulating tool as recited in claim 3, wherein the flexible cord is constructed of an elastic material.

7. A method of pulling a zipper located on the back of a garment, said zipper including a pull-tab with an eye, with a tool comprising a body provided with a hook means for releasably connecting to said eye in the zipper pull-tab, a cap, and a cord attached between said cap and said body, said method comprising steps of:

a) detaching said cap from the tool body;

b) inserting said hook means through said eye in the zipper pull-tab; and c) pulling said cap in a desired direction to open or close said zipper.

* * * * *